US006688046B2

(12) United States Patent
Perkins

(10) Patent No.: US 6,688,046 B2
(45) Date of Patent: Feb. 10, 2004

(54) ASSEMBLY OF A SAFETY RAIL FOR AN ACCESS HATCH

(75) Inventor: Simon Perkins, West Falls, NY (US)

(73) Assignee: Kee International Products Inc., Buffalo, NY (US)

( * ) Notice: Subject to any disclaimer, the term of this patent is extended or adjusted under 35 U.S.C. 154(b) by 0 days.

(21) Appl. No.: 10/140,063

(22) Filed: May 8, 2002

(65) Prior Publication Data

US 2003/0208965 A1 Nov. 13, 2003

(51) Int. Cl.[7] ..... E04F 19/08; E04H 17/00

(52) U.S. Cl. ..... 52/19; 256/65.01; 256/65.02; 256/65.03; 256/65.04

(58) Field of Search ..... 52/19; 256/19, 256/59, 65.01, 67, 65.02, 65.03, 65.04, 65.05, 65.14

(56) References Cited

U.S. PATENT DOCUMENTS 1,316,155 A * 9/1919 Harrison ..... 256/65.05
2,905,126 A * 9/1959 Gaffey ..... 114/364
3,055,024 A * 9/1962 Schmitt ..... 114/364
3,522,960 A * 8/1970 Moore ..... 403/234
3,995,833 A * 12/1976 McLaughlin et al. ..... 256/59
4,053,140 A * 10/1977 Clemens et al. ..... 256/19
4,208,038 A * 6/1980 Reid ..... 256/67
4,461,461 A * 7/1984 Caron ..... 256/19
4,892,292 A * 1/1990 Russell ..... 256/66
6,039,308 A * 3/2000 Venegas, Jr. ..... 256/73
6,131,886 A * 10/2000 Venegas, Jr. ..... 256/59
6,142,453 A * 11/2000 Martin ..... 256/65.05
6,167,659 B1 * 1/2001 Swindell, III ..... 52/20
6,272,800 B1 * 8/2001 Phinney et al. ..... 52/200
6,279,880 B1 * 8/2001 Hawks, Jr. ..... 256/67
6,283,457 B1 * 9/2001 Venegas, Jr. ..... 256/65.05
6,328,285 B1 * 12/2001 Wiseman ..... 256/59
6,467,230 B1 * 10/2002 Perkins et al. ..... 52/655.1
6,565,279 B1 * 5/2003 Skovronski et al. ..... 403/192
2001/0035523 A1 * 11/2001 Venegas ..... 256/65
2002/0104987 A1 * 8/2002 Purvis ..... 256/65.14
2003/0094604 A1 * 5/2003 Higgs et al. ..... 256/65.01

* cited by examiner

*Primary Examiner*—Carl D. Friedman
*Assistant Examiner*—Kevin McDermott
(74) *Attorney, Agent, or Firm*—Young & Thompson

(57) ABSTRACT

A safety rail assembly for an access hatch with a hatch frame which defines an opening; extends around at least a part of the hatch frame and includes guard members interconnection members which extend around the hatch frame, and support members for supporting the guard members at a position elevated above the hatch frame, where each interconnection member has a spacer member secured therto between the ends thereof, and each spacer member has a body portion by which the spacer member is secured to an interconnection member and a head portion for bearing firmly against an outwardly facing surface of the hatch frame.

19 Claims, 4 Drawing Sheets

ASSEMBLY OF A SAFETY RAIL FOR AN ACCESS HATCH

BACKGROUND OF THE INVENTION

This invention relates to an assembly of a safety rail for an access hatch and in particular, though not exclusively, for an access hatch for personnel whereby personnel may, for example, gain access to the roof of a building from within the building or vice versa. It relates also to a safety hatch assembly comprising a safety rail assembly and an access hatch, and to a method of forming said assembly.

For an installation comprising a hatch of a size intended for through movement of personnel, or a hatch through which personnel may inadvertently fall, for example a hatch opening in the top of a liquid storage tank, it is known to provide the hatch with a guard rail firmly bolted or similarly rigidly secured to the roof surface or to the hatch frame.

Whilst it is thereby possible to provide an effective safety rail installation, a need for expenditure and care of installation arises due to the requirement to bolt either to an existing surface surrounding the hatch frame or to the hatch frame. The need for expenditure and care is particularly apparent in the case of a retro-fit requirement in which it is necessary to provide an existing access hatch with a surrounding safety rail installation.

SUMMARY OF THE INVENTION

An object of the present invention is to provide a safety rail assembly for an access hatch, and a safety hatch assembly of a safety rail assembly and access hatch in which the safety rail assembly can be provided in a more cost effective and simpler manner than hitherto.

A further object of the present invention is to provide a safety rail assembly, a safety hatch assembly and method of forming a hatch assembly which is of a modular type and adaptable to accommodate hatch frames of a range of sizes In accordance with one aspect of the present invention there is provided a safety rail assembly for an access hatch of a kind comprising a hatch frame which defines an opening, said safety rail assembly being adapted to extend around at least a part of a hatch frame thereby to safeguard personnel from inadvertent entry into the hatch opening, said safety rail assembly comprising guard members which in use extend at least in part substantially horizontally, elongate rigid interconnection members which in use extend substantially horizontally around the hatch frame, support members for supporting the guard members at a position elevated above the hatch frame, said support members each having associated therewith a foot portion for resting in a free-standing manner on a support surface surrounding the hatch frame, and said support members each having secured thereto a connector device for securing an end region of one interconnection member relative to an end region of another of the interconnection members, and each said interconnection member having a spacer member secured thereto, between the ends thereof, each said spacer member comprising a body portion by which the spacer member is secured to an interconnection member and a head portion for bearing firmly against an outwardly facing surface of the hatch frame.

Preferably said body portion is tubular whereby the interconnection member may extend therethrough.

The body portion of at least one said spacer member may comprise retention means such as a screw threaded aperture for a grub screw which is engageable with the interconnection member to secure the spacer member relative to the interconnection member in a selectively releasable manner.

Alternatively a spacer member may be secured to the interconnection member in a substantially non-releasable manner, e.g. by welding. Similarly the invention envisages that whilst the connections between the other component parts preferably are of a selectively releasable type, at least some of the connections may be non-releasable, e.g. welded.

Preferably each said connector device secures two neighbouring end regions relative to one another and to a respective one of the support members at a position which is spaced above said support surface but surrounds the hatch frame, said reference to a position that surrounds the hatch frame referring to a position which lies no further from the support surface than the distance by which the hatch frame extends above that surface.

By causing the spacer members to bear firmly against the hatch frame as a result of reaction forces in interconnection members, the invention avoids any need to screw into or otherwise potentially damage the hatch frame and the weather resistance thereof. Furthermore the safety rail assembly is readily removable when not required, and by virtue of a modular nature can be fitted to a range of differently sized hatch frames without any need for having available a large number of different component parts.

The access hatch may comprise a closure member selectively moveable to open or close an opening defined by said frame and said closure member may have a periphery which at least in part, as considered in plan, extends horizontally outwards beyond at least one outwardly facing surface of the hatch frame. The spacer members preferably are of a size, between the head and body portions thereof, which is sufficient to ensure that the guard members and support members are off-set sufficiently to avoid impeding opening and closing movements of the hatch closure member.

The hatch closure member may comprise a weather deflector in the form of a skirt portion that extends downwardly from at least a part of said periphery of the closure member. Said guard section preferably extends downwardly by less than the height, preferably less than 50% of said height, by which the hatch frame extends above the surrounding support surface.

A spacer member may have a head portion provided with a substantially flat surface for bearing against an outwardly facing surface of the hatch frame, e.g a substantially vertical outwardly facing surface. Said flat surface may have a layer of facing material secured thereto and which in the hatch assembly lies interposed between the head portion and the hatch frame. The layer of facing material may be a layer of resilient material such as rubber, or another material which provides protection against damage to the surface against which it bears and or provides frictional resistance to sliding movement.

An example of a particularly suitable type of spacer member is that commercially available as a flanged mounting under the reference "Type 70" ex Kee Klamp Limited. That comprises a tubular body portion having a screw threaded aperture for receiving a grub screw by which the body is secured to a tube extending therethrough, a rectangular plate as a head portion and a neck portion which extends between the head and body portions, with the head portion lying in a plane which is substantially parallel with the major, longitudinal axis of the body portion. The rectangular plate is provided with the apertures employed normally for location of retention bolts or screws by which the flanged mounting is secured to a supporting structure, but in accordance with this invention those apertures may be employed to secure facing material to the head portion; countersunk bolts may be located in the facing material and extend through the apertures to engage with retention nuts.

Typically the hatch frame will be of a rectangular shape, in which case the present invention teaches that in forming the safety hatch assembly of the hatch frame and safety rail assembly the spacer members at an opposing pair of sides of the frame are caused to bear firmly against said frame sides and thereby firmly hold the safety rail assembly in position relative to the frame.

The connector devices by which the interconnection members are secured relative to support members may be orientated such that for at least some of the connector devices their throughbores extend perpendicular to the interconnection members that support those spacer members which are to bear firmly against sides of the hatch frame. In consequence the safety rail assembly may be firmly located relative to the hatch frame by sliding the ends of the interconnection members, e.g. straight tubes, through the connector devices until spacer members bear firmly against the frame sides, and then securing the connector devices and interconnection members relative to one another whilst a temporarily applied force is employed to hold the spacer members firmly against the frame.

As an alternative to temporarily applying force whilst components of the safety rail assembly are locked in position, the safety rail assembly may be constructed and positioned about the frame and adjustable means such as a clamp device or a jack may then be employed to causing spacer members to bear firmly against at least one opposing pair of frame sides. For example an interconnection member may incorporate a screw adjustment which enables the length of the member to be decreased, or a spacer member may incorporate a screw adjustment to enable the head portion to be increased in spacing from the tubular body portion.

The interconnection members typically may be in the form of a rod or tube. The spacer members may each be secured to an interconnection member at a position spaced inwards from an end region at which the interconnection member is secured to a connector device. In consequence, during assembly of the components for forming the safety rail assembly, the flexibility of an interconnection member over that part of its length between the spacer member and connector device may be used advantageously to cause the interconnection members to be held in the assembly in a deformed, e.g. bent, condition thereby to cause the spacer members to bear firmly against the hatch frame. Preferably a spacer member lies spaced from the nearest connector device by a distance which is at least 10% and more preferably at least 15% of the length of the interconnection member between a pair of the connector devices.

The guard members may be of a rigid type and may be rigidly interconnected to one another and to support members whereby the safety rail assembly is a substantially rigid assembly.

Examples of rigid type guard members are metal bars or tubes and also panels of substantially rigid material such as metal plates or grids. A guard member in the form of a panel may be secured to a support member at two or more positions spaced along the length of the support member. However, it is not essential that the safety rail assembly comprises said rigid assembly of members.

A support member may be provided with a foot portion which, relative to the vertical position of an upwardly extending portion of the support member, extends outwards, away from the hatch frame. The foot portion may comprise a flat metal plate which is permanently secured, e.g. welded, to an end of a metal tube or rod that extends vertically upwards to support a guard member, or the foot portion may, for example, be a plate which has secured thereto, or formed integrally therewith, a stub post or socket to which the lower end of a tube or rod may be secured in a manner known per se.

It is not essential that the guard members are rigid. Thus one or more guard members at respective sides of the safety rail assembly may be comprised by a flexible member such as a metal chain or cable.

The guard members may extend between support members at only some of the sides of the frame, e.g. to inhibit inadvertent entry to a hatch opening from two or three directions. Alternatively guard members may be provided to form a safety barrier which inhibits entry from any direction, e.g. from any one of four directions each perpendicular to a respective one of four sides of a rectangular shaped hatch frame.

Typically the access hatch frame will be of a rectangular, eg. square or oblong, shape. However it is to be understood that the teaching of the subject invention may be applied also to an access hatch frame of another shape, such as a circular, oval or hexagonal shape, in which case the references herein to sides of the access hatch frame are to be interpreted as side regions each substantially perpendicular to a direction from which personnel might inadvertently approach the access hatch.

In addition to a safety rail assembly for an access hatch as herein defined the present invention provides also a safety hatch assembly and components therefor comprising a safety rail assembly and an access hatch wherein the safety rail and access hatch assemblies are inter-engageable thereby to ensure firm location of the safety rail.

BRIEF DESCRIPTION OF THE DRAWINGS

Embodiments of the present invention will now be described, by way of example only, with reference to the accompanying diagrammatic drawings in which.

DETAILED DESCRIPTION OF THE PREFERRED EMBODIMENTS

Figure 1:
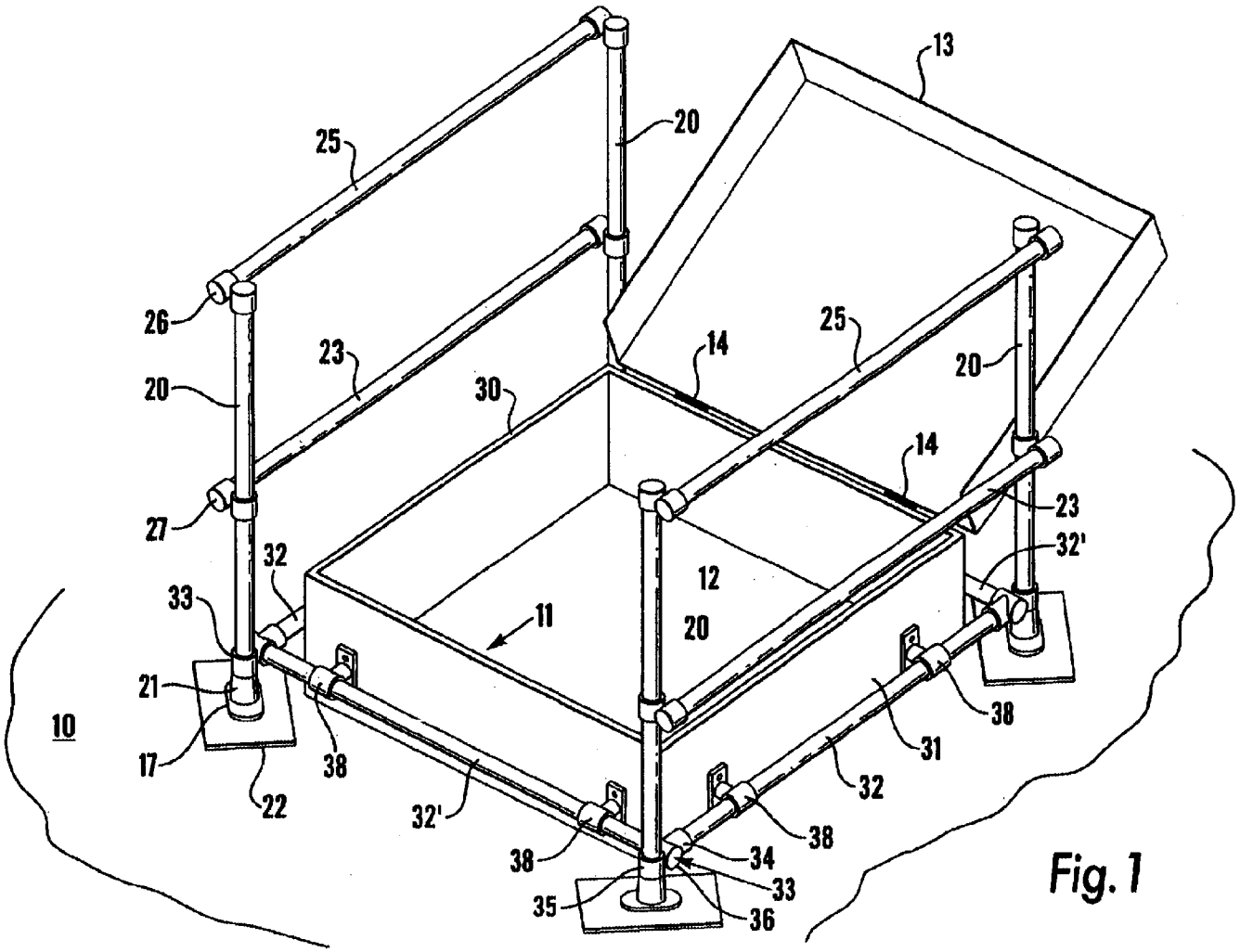
FIG. 1 is a perspective view of a safety rail and roof hatch assembly in accordance with one aspect of the present invention.

With reference to FIG. 1 a roof surface (10) has an opening the boundary of which is lined by a personnel access hatch frame (11) to one side (12) of which a closure panel (shown in outline 13) is hingedly mounted by hinges (14) whereby it may move between an open position, as shown, and a closed position in which it closes and seals the opening defined by the frame (11).

The safety rail installation for the personnel access hatch comprises four vertical posts (20) each having a lower end received in and secured in known manner in a socket (21) formed integrally with an end flange (17) that is secured by countersunk screws to the upper surface of a rectangular foot plate (22). The flanged socket (21) is shown in more detail in FIG. 2. Each support post (20) and foot plate (22) lies free-standing on the roof surface (10).

Two of the posts (20) at one side (30) of the frame are interconnected by a rigid upper guard rail (25) and a rigid middle guard rail (23), the rails (23,25) extending horizontally. The rails are secured to the posts by rigid tube connectors (26,27) of a kind known per se and shown more clearly in FIG. 3. The connectors (26,27) are each of a two-way offset cross—over type (available as Type 45 from Kee Klamp Limited). The offset connectors are positioned such that the horizontal rails (23,25) lie outwards of the posts (20) as considered relative to a frame side (30,31).

The upper horizontal rail (25) is connected to an upper end region of a post (20).

The middle rail (23) is secured to the posts (20) at a position substantially midway between the ends of the posts.

Two of the vertical posts (20) at the other, opposite side (31) of the frame are similarly interconnected by upper and middle guard rails (23,25).

The posts of each of said interconnected pairs of posts additionally are interconnected by interconnection members in the form of metal tubes (32). The tubes (32) each lie co-planar with their respective pairs of posts and are secured to those posts by 3-way type connectors (33). The connectors (33) are each of a 3-way type, shown more detailed in FIG. 4 (and available as Type 46 connector from Kee Kiamp Limited).

Each of connector (33) (see FIG. 4) comprises two throughbores (35,36) and a single blind bore (34). The blind bore (34) at one end of the fitting surrounds and is secured to an end of an interconnection tube (32) and a through bore (35) at the other end of the connector rests on the top of the base socket (21), with a post (20) extending through the bore (35). The other through bore (36) of each connector (33) receives and locates an end region of one of another pair of interconnection tubes ($32^1$) which extend substantially perpendicular to the aforedescribed tubes (32).

Figure 5:
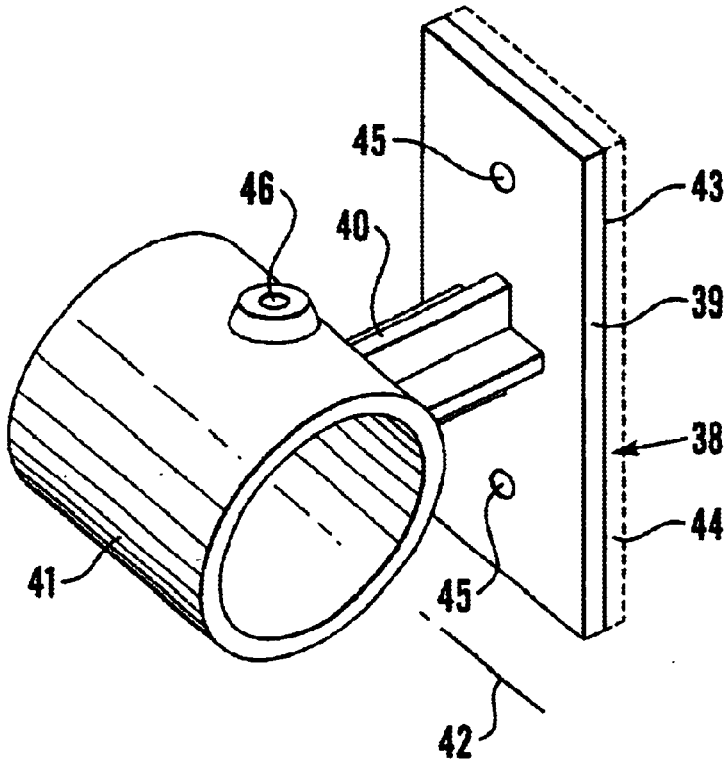

The four interconnection tubes (32, $32^1$) each lie spaced above the roof surface (10) but close thereto such that they surround the sides of the hatch frame (11). The tubes (32,$32^1$) additionally are each maintained spaced from the frame sides by a pair of spacer units (38). Each spacer unit is shown in more detail in FIG. 5 and comprises a flat head portion (39), a neck portion (40) and a tubular body portion (41) which defines a through bore the longitudinal axis (42) of which is parallel with an outer abutment face (43) of the head portion (39). A suitable spacer unit is that component available as type 70 from Kee Kiamp Limited.

Figure 2:
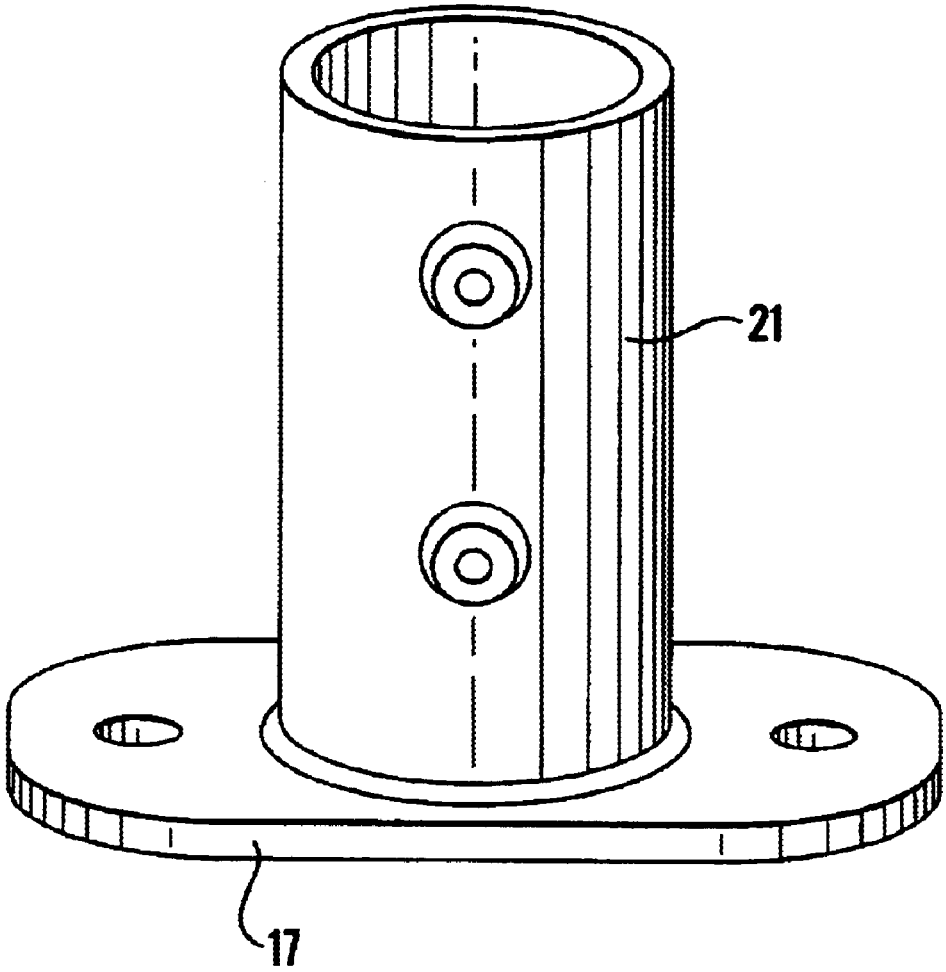
FIGS. 2 to 5 each show perspective views of component parts of the assembly of FIG. 1.
Figure 3:
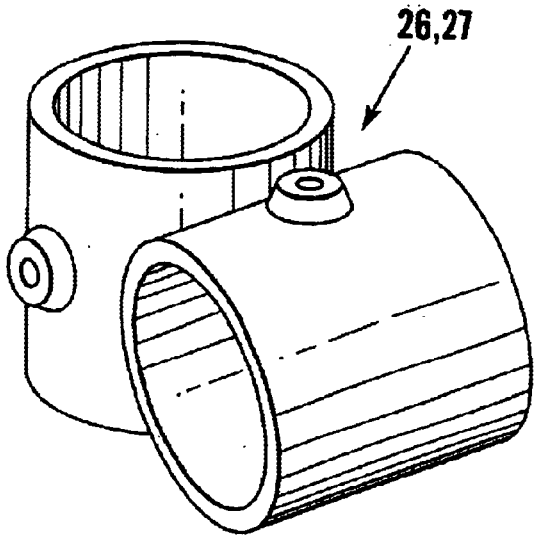
Figure 4:
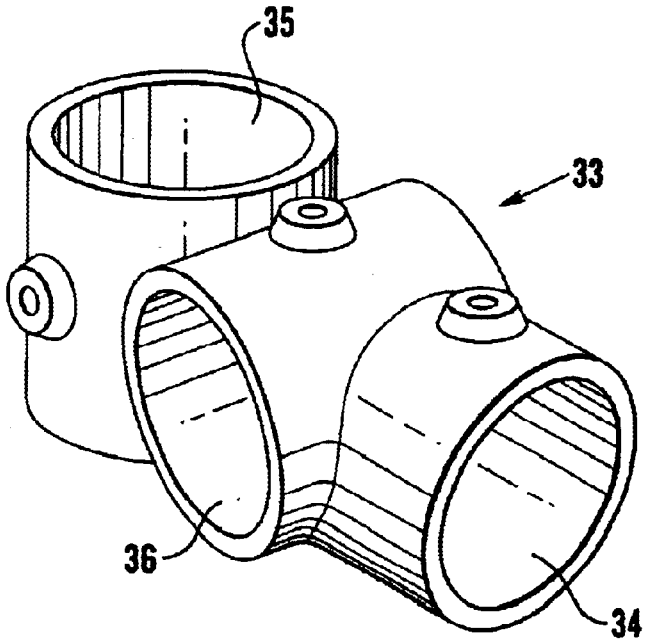

Each body portion (41) is provided with a screw threaded aperture (46) to receive a grub screw for locating the spacer unit relative to a tube (32, $32^1$), the aperture (46) corresponding to similar such apertures of the components shown in FIGS. 2 to 4.

A pad of rubber. (44) is secured to said abutment face (43) by means of two screws countersunk in the face of the rubber and extending through threaded holes (45) in the head portion (39) to engage retention nuts.

The two spacer units (38) of each interconnection tube (32,$32^1$) lie at a position from a vertical post which is between 15% and 20% of the distance between the associated pair of posts. Thus on assembly of the component parts each tube ($32^1$) can be secured in a through bore (36) of a 3-way connector (33) in a position at which it tends slightly to bend the tubes (32) such that the spacer units of the tubes (32) are thereby maintained firmly in contact with the frame sides. Similarly the lengths of the tubes (32) may be selected such that, within the axial length of the blind bore (34) of a connector (33), the tubes (32) may be secured to the connectors in a position which maintains the tubes ($32^1$) slightly bent such that spacer units (38) carried by those tubes ($32^1$) are also held firmly against the frame sides.

Figure 6:
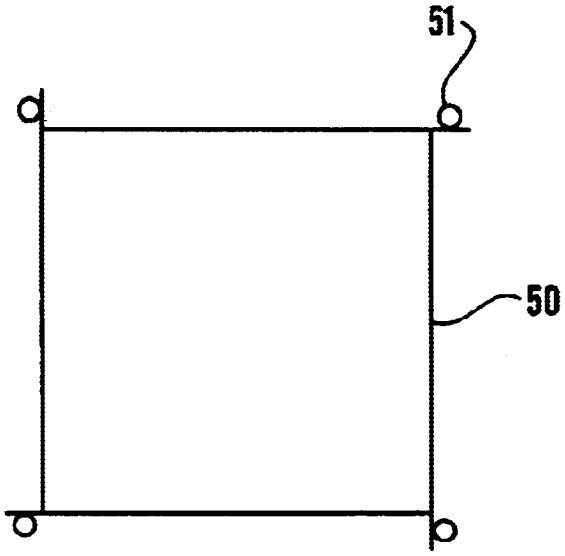
FIG. 6 is a plan view of part of a safety hatch assembly in accordance with another embodiment of the present invention.

FIG. 6 shows schematically an alternative configuration of interconnection tubes (50) arranged such that at each corner post position (51) one of the tubes potentially extends slightly beyond a 3-way connector (33), with the other end of that tube being received in a blind bore (34) of another connector. This configuration also readily allows the frame assembly to be firmly positioned relative to the a hatch frame, and again without the need to drill into or similarly form a permanent connection with the hatch frame.

Accordingly the present invention provides a safety rail assembly which is firmly locatable to a hatch frame but is easily selectively removable, and obviates any requirement to screw into or otherwise potentially damage a hatch frame.

What is claimed is:

1. A safety rail assembly for an access hatch of a kind comprising a hatch frame which defines an opening, said safety rail assembly being adapted to extend around at least a part of a hatch frame thereby to safeguard personnel from inadvertent entry into the hatch opening, said safety rail assembly comprising the hatch frame guard members which in use extend at least in part substantially horizontally, elongate rigid interconnection members which in use extend substantially horizontally around the hatch frame, support members for supporting the guard members at a position elevated above the hatch frame, said support members each having associated therewith a foot portion for resting in a free-standing manner on a support surface surrounding the hatch frame, and said support members each having secured thereto a connector device for securing an end region of one interconnection member relative to an end region of another of the interconnection members, and each said interconnection member having a spacer member secured thereto, between the ends thereof, each said spacer member comprising a body portion by which the spacer member is secured to an interconnection member and a head portion for bearing firmly against an outwardly facing surface of the hatch frame.

2. A safety rail assembly according to claim 1, wherein said body portion of the spacer member is tubular whereby the interconnection member extends therethrough.

3. A safety rail assembly according to claim 2, wherein said body portion comprises a retention means which is engageable with the interconnection member to secure the spacer member relative to the interconnection member in a selectively releasable manner.

4. A safety rail assembly according to claim 1, wherein connections between component parts of the assembly are of a selectively releasable type.

5. A safety rail assembly according to claim 1, wherein at least one said spacer member comprises a head portion provided with a substantially flat surface for bearing, in use, against an outwardly facing surface of the hatch frame.

6. A safety rail assembly according to claim 5, wherein said flat surface has a layer of facing material secured thereto and which in use in a hatch assembly lies interposed between the head portion and the hatch frame.

7. A safety rail assembly according to claim 6, wherein said layer of facing material provides at least one of protection against damage to the surface against which it bears and frictional resistance to sliding movement.

8. A safety rail assembly according to claim 1, wherein at least one of said spacer members comprises a tubular body portion having a screw threaded aperture for receiving a grub screw by which the body is secured to a tube extending therethrough, a rectangular plate as a head portion and a neck portion which extends between the head and body portions, with the head portion having a face which lies in a plane which is substantially parallel with the major, longitudinal axis of the body portion.

9. A safety rail assembly according to claim 1, wherein said connector devices are orientated such that the through-bore for at least one of the connector devices extends perpendicular to interconnection members that support spacer members which are to bear firmly against sides of the hatch frame.

10. A safety rail assembly according to claim 1, wherein the safety rail assembly comprises flexible means operable, in use, to cause the spacer members to bear firmly against at least one opposing pair of hatch frame sides.

11. A safety rail assembly according to claim 1, wherein said spacer members are each secured to an interconnection member at a position spaced inwards from an end region at which the interconnection member is secured to a connector device.

12. A safety rail assembly according to claim 11, wherein said spacer members lie spaced from the nearest connector device by a distance which is at least 10% of the length of the interconnection member between a pair of the connector devices.

13. A safety rail assembly for an access hatch of a kind comprising a hatch frame which defines an opening, said safety rail assembly being adapted to extend around at least a part of a hatch frame thereby to safeguard personnel from inadvertent entry into the hatch opening, said safety rail assembly comprising guard members which in use extend at least in part substantially horizontally, elongate rigid interconnection members which in use extend substantially horizontally around the hatch frame, support members for supporting the guard members at a position elevated above the hatch frame, said support members each having associated therewith a foot portion for resting in a free-standing manner on a support surface surrounding the hatch frame, and said support members each having secured thereto a connector device for securing an end region of one interconnection member relative to an end region of another of the interconnection members, and each said interconnection member having a spacer member secured thereto at a position which lies spaced from the nearest connector device by a distance which is at least 10% of the length of the interconnection member between a pair of the connector devices, each said spacer member comprising a tubular body portion having retention means by which the spacer member is secured to an interconnection member extending through said body portion, a head portion in the form of a plate for bearing in use firmly against a substantially vertical outwardly facing surface of the hatch frame and a neck portion which extends between the head and body portions with the head portion lying in a plane which is substantially parallel with the major, longitudinal axis of the body portion.

14. A safety hatch assembly comprising a safety rail assembly according to claim 1 and an access hatch wherein the spacer members of the safety rail assembly bear firmly against sides of the hatch frame thereby to firmly locate the safety rail assembly relative to the hatch frame.

15. A safety hatch assembly according to claim 14, wherein the hatch frame is of a rectangular shape and the spacer members at an opposing pair of sides of the frame bear firmly against frame sides.

16. A safety hatch assembly according to claim 14, wherein each said connector device secures two neighbouring end regions relative to one another and to a respective one of the support members at a position which is spaced above said support surface but surrounds the hatch frame.

17. A safety hatch assembly according to claim 14, wherein the access hatch comprises a closure member selectively moveable to open or close an opening defined by said frame and said closure has a periphery which at least in part, as considered in plan, extends horizontally outwards beyond at least one outwardly facing surface of the hatch frame.

18. A safety hatch assembly according to claim 17, wherein the spacer members serve to locate the guard members and support members off-set from the frame sides thereby to avoid impeding opening and closing movements of the hatch closure member.

19. A safety hatch assembly according to claim 14, wherein a support member is provided with a foot portion which, relative to the vertical position of an upwardly extending portion of the support member, extends outwards away from the hatch frame.

* * * * *

UNITED STATES PATENT AND TRADEMARK OFFICE

CERTIFICATE OF CORRECTION

PATENT NO. : 6,688,046 B2
DATED : February 10, 2004
INVENTOR(S) : Simon Perkins

It is certified that error appears in the above-identified patent and that said Letters Patent is hereby corrected as shown below:

Title page,
Item [73], should read:

-- [73] Assignee: Kee Industrial Products Inc.
Buffalo, NY (US) --.

Signed and Sealed this

Thirteenth Day of April, 2004

JON W. DUDAS
*Acting Director of the United States Patent and Trademark Office*